US010041244B2

(12) United States Patent
Hochstuhl

(10) Patent No.: US 10,041,244 B2
(45) Date of Patent: Aug. 7, 2018

(54) DEVICE AND METHOD FOR THE THERMAL DECOUPLING OF CONCRETE BUILDING PARTS

(71) Applicant: Schock Bauteile GmbH, Baden-Baden (DE)

(72) Inventor: Jochen Hochstuhl, Gernsbach (DE)

(73) Assignee: Schock Bauteile GmbH, Baden-Baden (DE)

( * ) Notice: Subject to any disclaimer, the term of this patent is extended or adjusted under 35 U.S.C. 154(b) by 0 days.

(21) Appl. No.: 15/137,520

(22) Filed: Apr. 25, 2016

(65) Prior Publication Data

US 2016/0312460 A1 Oct. 27, 2016

(30) Foreign Application Priority Data

Apr. 23, 2015 (DE) ..... 10 2015 106 294

(51) Int. Cl.
*E04B 1/41* (2006.01)
*E04B 1/16* (2006.01)
(Continued)

(52) U.S. Cl.
CPC ..... *E04B 1/41* (2013.01); *E04B 1/165* (2013.01); *E04B 1/76* (2013.01); *E04B 1/78* (2013.01);
(Continued)

(58) Field of Classification Search
CPC ... E04B 1/41; E04B 1/76; E04B 1/165; E04B 1/78; E04B 2001/7679; E04B 2103/02; E04C 5/06; E04C 5/0604; E04C 3/34
See application file for complete search history.

(56) References Cited

U.S. PATENT DOCUMENTS 4,001,990 A * 1/1977 Chase ..... E04H 9/02 52/167.4
4,240,233 A * 12/1980 Vercelletto ..... E04B 2/8611 52/127.3
(Continued)

FOREIGN PATENT DOCUMENTS

CH 710940 A2 * 10/2016 ..... E04B 1/161
DE 19823100 1/2000
(Continued)

OTHER PUBLICATIONS

EGCO AG: ALPHADOCK—Der neue Wandanschluss fur thermisch getrennte Wande (The New Wall Connector for Thermally Separated Walls) Bosingen (CH), Apr. 2014.—Firmenschrift.

*Primary Examiner* — Babajide A Demuren
(74) *Attorney, Agent, or Firm* — Volpe and Koenig, P.C.

(57) ABSTRACT

In a load-bearing concrete vertical building part, particularly a support, with an upper support area for a load-transferring connection to a concrete horizontal building part thereabove, in which the vertical building part includes reinforcements with reinforcement rods extending essentially vertically beyond the upper support area, an upper section of the vertical building part abutting the upper support area is embodied as a thermal insulation element for the thermal decoupling of the vertical building part from the horizontal building. The upper section forming the thermal insulation element is made at least partially from a compressive load transferring and thermally insulating material, particularly light-weight concrete, and reinforcement rods extending beyond the upper support area are made from a fiber composite material, and extend through the upper section of the vertical building part forming the thermal insulation element essentially vertically to the lower section of the vertical building part located underneath thereof.

10 Claims, 6 Drawing Sheets

(51) Int. Cl.

| | |
|---|---|
| ***E04B 1/78*** | (2006.01) |
| ***E04B 1/76*** | (2006.01) |
| ***E04C 5/06*** | (2006.01) |
| *E04C 3/34* | (2006.01) |

(52) U.S. Cl.
CPC ..... *E04C 5/06* (2013.01); *E04B 2001/7679* (2013.01); *E04B 2103/02* (2013.01); *E04C 3/34* (2013.01); *E04C 5/0604* (2013.01)

(56) References Cited

U.S. PATENT DOCUMENTS

| | | | | |
|---|---|---|---|---|
| 8,132,388 | B2 * | 3/2012 | Nagy | E04B 1/04 52/250 |
| 8,590,240 | B2 | 11/2013 | Koch | |
| 2004/0216404 | A1 * | 11/2004 | Black | E04B 1/3555 52/250 |
| 2012/0144772 | A1 * | 6/2012 | Koch | E04B 1/161 52/700 |
| 2012/0159884 | A1 * | 6/2012 | Koch | E04B 1/161 52/396.05 |
| 2012/0186176 | A1 * | 7/2012 | Koch | E04B 1/161 52/291 |

FOREIGN PATENT DOCUMENTS

| | | | | |
|---|---|---|---|---|
| DE | 10106222 | | 8/2002 | |
| DE | 202005019077 | | 5/2007 | |
| EP | 0745733 | | 12/1996 | |
| EP | 1154086 | A2 * | 11/2001 | E04B 1/78 |
| EP | 2405065 | | 1/2012 | |
| FR | 2804703 | A1 * | 8/2001 | E04B 1/0038 |
| FR | 2868448 | B1 * | 1/2007 | E04B 1/0038 |
| WO | WO 2006090048 | A1 * | 8/2006 | E04C 3/34 |

* cited by examiner

DEVICE AND METHOD FOR THE THERMAL DECOUPLING OF CONCRETE BUILDING PARTS

INCORPORATION BY REFERENCE

The following documents are incorporated herein by reference as if fully set forth: German Patent Application No. 102015106294.1, filed Apr. 23, 2015.

BACKGROUND

The present invention relates to a load bearing, vertical building part made from concrete, particularly a support, comprising a first support area for the load-transferring connection to a horizontal building part to be constructed from concrete and located above or below thereof, particularly a ceiling or a floor as well as a method for the construction of such a building part. Additionally the invention relates to a thermal insulation element for the thermal decoupling of load bearing building parts to be made from concrete, preferably a vertical building part, particularly a support, from a horizontal building part located above or below thereof, particularly a ceiling or a floor.

In above-ground construction, frequently load bearing building parts are made from reinforced concrete constructions. For energy-saving reasons, such building parts are generally provided with a thermal insulation applied at the outside. In particular the ceiling between the underground level, such as a basement or underground garage, and the ground floor is frequently equipped at the side of the underground level with a thermal insulation applied at said ceiling. Here, the difficulty is given in that the load bearing building parts, on which the building rests such as supports and exterior walls, must be connected in a load-transferring fashion to the building parts located thereabove, particularly the ceiling. This is generally achieved such that the ceiling is connected in a monolithic fashion with continuous reinforcements to the load bearing supports and the exterior walls. However, here heat bridges develop which can only be compensated with difficulty by thermal insulation that is subsequently applied to the outside. In underground garages, for example frequently the upper section of the load bearing concrete supports, pointing toward the ceiling, is also coated with thermal insulation. This is not only expensive but also visually not very appealing, but it also yields unsatisfactory results with regards to the physics of the construction and furthermore reduces the parking space available in the underground parking garage.

A brick-shaped wall element is described in DE 101 06 222 for thermally decoupling wall parts and floor or ceiling parts. The thermal insulation element has a pressure-resistant support structure with insulating elements arranged in the interim spaces. The support structure may be made from light-weight concrete, for example. Such a thermal insulation element serves for the thermal insulation of exterior masonry walls, for example by using it like a conventional brick for the first layer of bricks of the load bearing exterior wall above the basement ceiling.

A compressive load-transferring and insulating connection element is known from EP 2 405 065, which can be used for the vertical, load-transferring connection of building parts to be made from concrete. It comprises an isolating body with one or more compressive load bearing elements embedded therein. Lateral reinforcement elements extend through the compressive load bearing elements to building parts to be erected from concrete abutting thereto essentially vertically beyond the top and the bottom of the insulation body. The isolation body can for example be made from cellular glass or expanded rigid polystyrene foam, and the compressive load bearing elements from concrete, asbestos cement, or fibrous synthetic material.

The approach proposed here for the vertical thermal decoupling of building parts to be made from concrete therefore comprises to reduce the support area between the building parts in order to reduce the thermal transfer. However, when force is introduced into a plate support structure, such as a floor, and concentrated to a reduced area, here the risk is increased that at the point the force is introduced the plate support structure can break, resulting in so-called punching.

Additionally, the load resting on a concrete floor may lead to minor settlement and/or elastic deformations. This leads to a redistribution of force at the support points at which the floors are carried by the underlying vertical building parts. Such a support distortion may lead to overloading the compressive load carrying element. If in a single support several compressive load carrying elements are used and one of them fails, here the load is distributed over the adjacent compressive load carrying elements, which then also were subject to overload. This can lead to a chain reaction with fatal consequences for the static structure of the building.

SUMMARY

One objective of the invention therefore includes to provide a load bearing vertical building part made from concrete, particularly a support, with a first support area for the load transferring connection to a horizontal building part to be made from concrete and positioned above or below thereof, particularly a ceiling, as well as a respective method for preparing such a building part, which on the one hand reduces the thermal transfer between the building parts and on the other hand reduces the risk of a local overload at the support points.

Another objective of the invention is to provide a thermal insulation element for the thermal decoupling of load bearing building parts to be produced from concrete, preferably a vertical building part, particularly a support, and a horizontal building part located above or below thereof, particularly a ceiling, in which the risk of local overload at the support points is reduced.

The objective is attained with regards to the building part, the thermal insulation elements, and a method including one or more features of the invention, Advantageous embodiments are discernible from the description below and the claims.

In the load bearing, vertical building part to be made from concrete, particularly a support comprising a first support area for the load transferring connection to a horizontal building part to be made from concrete and located above or below thereof, particularly a ceiling, in which the vertical building part has a reinforcement with one or more rod-shaped reinforcements extending essentially vertically beyond the first support area, particularly reinforcement rods, the objective is attained according to the invention in that an area of the vertical building part abutting the first support area is embodied as a thermal insulation element for the thermal decoupling of the vertical building part from the horizontal building part to be produced above or below thereof, that the section forming the thermal insulation element at least partially comprises a compressive load transferring and thermally insulating material, particularly light-weight concrete, and that the reinforcement rods extending beyond the upper support area are made from a fiber composite and essentially extend vertically through the first section of the vertical building part forming the thermal insulation element to a second section of the vertical building part abutting it, in which it is made from reinforced standard concrete.

The thermal insulation element is therefore made at least sectionally from a compressive load transmitting and thermally insulating material, such as light-weight concrete. High-strength form elements can be produced from light-weight concrete, having lower specific thermal conductivity. Depending on the static requirements, such a part made from light-weight concrete may comprise additional cavities or enclosed insulating bodies. The height of the thermal insulation element is here preferably approximately equivalent to the thickness of a typical thermal insulation layer, thus ranging approximately from 5 to 20 cm, preferably from 10 to 15 cm.

Light-weight concrete according to present regulations is defined as concrete having a dry density of maximally 2000 $kg/m^3$. The low density compared to standard concrete is achieved by appropriate production methods and different light-weight grain sizes, preferably grains with a core porosity of expanded clay. Depending on composition, light-weight concrete exhibits a thermal conductivity from 0.2 to 1.6 W/(m·K).

With the use of a massive thermal insulation element or one produced as a hollow block comprising light-weight concrete, here with the same or lower thermal loss a considerably greater support area is provided than otherwise possible when using high-pressure resistant compressive load bearing elements. By the large-area load transfer, contrary to compressive load bearing elements of prior art, the risk is avoided that settlements or elastic deformations of the building part located above or minor weak spots in the connection to the underlying building part, for example due to the formation of cavities or sedimentation, here a local overload results and thus a failure of the thermal insulation element.

The improved and more secure connection of the building parts made from concrete is primarily yielded in that with identical strength classification here the coefficient of elasticity of light-weight concrete amounts only from approximately 30 to 70% of the values of standard concrete. Accordingly, the elastic deformations under identical stress (tension) are on average 1.5 to 3 times greater. For this reason the thermal insulation element made from light-weight concrete acts simultaneously as a tension release element and is capable to compensate minor settlements and elastic deformations of the building part located above and ensures a more homogenous distribution and force introduction of eccentric loads upon and/or into the underlying building part.

The considerably lower coefficient of elasticity of the light-weight concrete used here acts in a particularly beneficial fashion upon load-eccentricity and support distortions, which lead to increased pressure upon edges. Based on its elastic features the thermal insulation element acts like a "centering element". In contrast thereto, the compression under central loading is of secondary importance.

The typical coefficient of elasticity of standard concrete, as used for supports, ranges from $E_{cm}$=30,000 to 40,000 $N/mm^2$. The coefficient of elasticity of the light-weight concrete preferred within the scope of the invention ranges therefore from approximately 9,000 to 22,000 $N/mm^2$, preferably from 12,000 to 16,000 $N/mm^2$, and most preferably amounts to approximately 14,000 $N/mm^2$.

While in conventional, vertically arranged steel concrete parts with a content of reinforcement of 3-4%, the steel reinforcement contributes to approximately half of the overall thermal conductivity of the building part, the combination of light-weight concrete with a reinforcement made from fiber composite material according to the invention lowers the thermal conductivity by approximately 90% in the proximity of the thermal insulation element.

The mentioned upper section of the vertical building part therefore not only acts as a thermal insulation element with regards to structural physics and as a load transferring part with regards to static loads, but furthermore also as a tension absorbing element to compensate mechanical deformations. Here it is irrelevant if the thermal insulation element made from light-weight concrete is delivered to the construction site, installed there in the casing for the vertical building part, and the latter is connected from the bottom by concrete towards the bottom contact area of the thermal insulation element, or if the thermal insulation element is prepared on site from a special light-weight concrete in the casing of the vertical building part.

In a preferred embodiment the thermal insulation element is however embodied as a pre-fabricated form part. The invention relates therefore also to a thermal insulation element for the thermal decoupling of load bearing building parts to be made from concrete, preferably a vertical building part, particularly a support, from a horizontal building part located above or below thereof, particularly a ceiling. The thermal insulation element comprises a basic body with an upper and a lower support area for the vertical connection to the building parts. According to the invention the basic body of the thermal insulation element comprises at least partially a compressive load transferring and thermally insulating material, particularly light-weight concrete, and has one or more rod-shaped reinforcing elements extending essentially vertically beyond the upper and the lower support area, particularly reinforcing rods made from a fiber composite.

Light-weight concrete can be better produced and processed under factory conditions than on a construction site, so that thermal insulation element prefabricated in a factory can achieve higher compressive strength classifications than those made from cast-in-place concrete.

In a preferred embodiment of such a prefabricated thermal insulation element the reinforcement rods are inserted in sheaths, which are embedded in the compressive load transferring material. The sheaths serve as dead casings for the subsequent insertion of the reinforcement rods. Although reinforcement rods made from fiber composite materials can compensate high tensile forces, contrary thereto however much lower compressive loads can lead to the destruction of such reinforcement rods. By the use of sheaths, here a form-fitting embedding of the reinforcement rods into the surrounding concrete is avoided, which usually is intended and almost unavoidable in concrete reinforcements. When a compressive load is applied, for example because of building settlement, the reinforcement rods can elastically deform in their sheaths until the pressure has been completely transferred by the surrounding compression load resistant insulation body made from light-weight concrete, so that any damaging compressive loads upon the reinforcement rods are avoided.

The reinforcement rods in the thermal insulation element are beneficially designed as tensile reinforcements, because the connection between the support and the ceiling located thereabove can be considered a link with regards to statics. This way, by the use of the sheaths for guiding reinforcements made from fiber composites materials without connections thereto, here stable and permanent connections and/or monolithic connections can be generated between the support and the ceiling with continuous reinforcements, meeting the static requirements.

In one advantageous further development of the thermal insulation element it comprises at least one penetrating opening extending from the upper to the lower support area, which is embodied for passing a compensation device for fresh concrete. The penetrating opening serves therefore as an immersion site for the internal vibrator. Preferably the penetrating opening in the thermal insulation element is arranged approximately in the middle.

This is based on the acknowledgement that during the installation and the subsequent concrete casting against the bottom of the thermal insulation element here insufficient or undefined compacting of the cast-in-place concrete can occur underneath the thermal insulation element, which additionally largely depends on the composition of the cast-in-place concrete. According to the acknowledgement of the invention at the bottom of the thermal insulation element two processes during the setting of the cast-in-place concrete may lead to the load transferring connection of the thermal insulation element to the underlying building part being insufficient. On the one hand, rising air bubbles, so-called compression pores, may lead to cavities at the bottom of the thermal insulation element and this way result in a connection insufficient for the static requirements. Sedimentation represents an even more critical process in the cast-in-place concrete not yet completely set, in which heavier additives slowly sink and water and/or cement paste separates at the surface of the concrete. After the concrete part has set and dried, in this case large cavities can form between the thermal insulation element and the underlying concrete part, which are not visible from the outside.

In order to avoid this, in the thermal insulation element according to the invention a penetrating opening is provided, through which a compacting device, such as a vibration head of a concrete vibrator, can be guided in order to compact and/or subsequently compact the cast-in-place concrete located underneath the thermal insulation element after installation thereof. By this compacting and/or subsequent compacting the problems described above can be avoided and a reliable connection of the thermal insulation element to the building part located underneath thereof can be achieved. The penetrating opening can additionally be used as the inlet opening for the cast-in-place concrete as well.

Another advantage of the present invention develops when the lower support area of the thermal insulation element shows a surface with a three-dimensional profile. By an appropriate profiling of the surface the defects in the connection between the thermal insulation element and the underlying freshly prepared concrete building part can be further reduced. For example, the surface may show projections and recesses as well as inclined areas, grooves, or the like so that in case of sedimentation developing the precipitating surface water can drain into non-critical areas and/or precipitate there, while in areas of the thermal insulation element critical for the static connection a close connection develops to the freshly created concrete of the underlying building part.

In this context an embodiment is considered particularly preferred in which the lower support area has a funnel-shaped surface declined or arched in the direction of the penetrating opening. This way it is achieved that in case of sedimentation occurring the surface water precipitating is displaced towards the penetrating opening and/or only forms in this area, which is not contributing to the static of the construction anyway.

Furthermore, it has proven advantageous to arrange a reinforcing bar inside the compressive load-transferring thermal insulation element. Such a reinforcing bar in the form of a closed reinforcing ring, showing for example a circular or polygonal cross-section with rounded edges which is arranged in reference to the support areas essentially in a parallel level, can further increase the pressure resistance of the thermal insulation element by minimizing the lateral extension of the thermal insulation element under pressure.

In addition to the penetrating opening for the vibration tool, additional casting openings may be provided in the thermal insulation element via which any additional casting material required after the concrete has cured, such as casting mortar, can be injected in to fill out any potentially remaining cavities between the underlying building part and the thermal insulation element. Preferably the respective casting openings are closed via removable plugs so that they cannot be clogged by cast-in-place concrete during the installation of the thermal installation element.

Furthermore, within the scope of the present invention it is preferred that a closing plug is provided by which the penetrating opening can subsequently be closed. Here, it is further preferred that the closing plug is made from a thermally insulating but non-load bearing material, such as extruded polystyrene. Additionally, such a closing plug can be shaped conically such that it can be inserted in a sealing fashion into the penetrating opening, preferably also conically tapering towards the bottom. This way it is ensured that after the installation of the thermally insulating element no heat bridge remains through said penetrating opening, for example based on cast-in-place concrete seeping into the penetrating opening during the formation of the concrete ceiling located underneath.

In order to allow passing a vibration tool, for example the vibrating head of a concrete vibrator, the penetrating opening have an opening size, which is sufficient to allow passing through it vibration heads common on construction sites, particularly having at least 50 mm, preferably ranging from 60 to 80 mm.

In an alternative embodiment of the invention the objective mentioned at the outset can also be attained in a thermal insulation element such that, instead of rod-shaped reinforcement elements, here one or more sheaths are inserted penetrating the thermal insulation element from the upper to the lower support area, which are embedded as dead casings in the compressive load transferring material and are essentially embodied for the subsequent insertion and/or unconnected passing of rod-shaped reinforcement elements, particularly reinforcement rods extending beyond the upper and the lower support area.

On the one hand, as already explained, a form-fitting embedding of the reinforcement rods in the surrounding concrete is avoided by the use of sheaths so that in case a fiber composite material is used for the reinforcement elements damaging compressive loads upon the reinforcement rods are avoided. On the other hand, such a design shows considerable advantages in the production of the thermal insulation elements according to the invention. Namely, if such a thermal insulation element is produced under factory conditions, it is easier to insert a casing for the thermal insulation element than reinforcing elements which need to penetrate the thermal insulation element at both sides and which have to be sealed in reference to the casing. The storage is also considerably simplified when prefabricated thermal insulation elements are embodied without cumbersome reinforcement rods and the latter are only inserted into the sheaths of the thermal insulation element at the construction site during the installation of the thermal insulation element into a support or wall. Such a thermal insulation element allows furthermore the use of reinforcement rods made from stainless steel, for example, if at a certain time no reinforcement rods made from fiber composite materials are available or undesired for other reasons.

The invention further relates to a method for erecting a vertical building part made from concrete, particularly a support, comprising a first support area for the load transferring connection to a horizontal building part to be produced from concrete above or below thereof, particularly a ceiling. Here, a first section of the vertical building part is made from reinforced standard concrete. A second section of the vertical building part located between the first support area and the first section of the vertical building part is at least partially formed from a pressure transferring and thermally insulating material, particularly light-weight concrete, in order to serve as a thermal insulation element for the thermal decoupling of the vertical building part from the horizontal building part to be produced above or below thereof. Additionally, rod-shaped reinforcement elements, particularly reinforcement rods, are installed in the second section of the vertical building part forming the thermal insulation element, made from a fiber composite material, which extend through the second section of the vertical building part essentially vertically to the abutting first section and beyond the first contact area.

The thermal insulation element may represent a prefabricated light-weight concrete part. In this case, a reinforcement is prepared for the first section of the vertical building part and a casing arranged around said reinforcement. Fresh standard concrete is filled into the casing over the full height of the first section of the vertical building part. The second section of the vertical building part is formed by the prefabricated thermal insulation element, which is inserted in the casing.

Here, the first section can either be formed from concrete before the thermal insulation element is inserted, or the thermal insulation element can also be inserted into the casing before the concrete of the first section is cast.

In the first case, initially the first, lower section is cast in concrete by cast-in-place concrete being filled into the casing and compacted. Then in a second step the thermal insulation element is inserted into the casing. Here, the reinforcement rods projecting towards the bottom beyond the thermal insulation element are pressed into the fresh cast-in-place concrete of the first section. Subsequently preferably a post-compacting of the concrete occurs by a compacting device, which is guided through a penetrating opening in the thermal insulation element. Preferably the penetrating opening can then be closed with a closing plug. Thereafter the horizontal building part, for example a ceiling, can be produced above the thermal insulation element in a common fashion.

By the subsequent compression of the still fresh cast-in-place concrete of the lower building part after the insertion of the thermal insulation element it is ensured that close contact is given to its lower contact area and cavities caused by the formation of bubbles and sedimentation are avoided between the thermal insulation element and the building part located underneath.

In the second case the thermal insulation element can also be installed prior to filling cast-in-place concrete into the casing. In this case a penetrating opening provided in the thermal insulation element can initially be used as the inlet opening for filling in said cast-in-place concrete. Subsequently the concrete filled in is compacted by the vibration tool being inserted through the inlet opening into the freshly cast-in-place concrete.

Alternatively, the thermal insulation element can also be produced from cast-in-place concrete on site. For this purpose initially the reinforcement is produced for the first, lower section of the vertical building part and a casing arranged about said reinforcement. In an upper section of the reinforcement, which is equivalent to the second section of the vertical building part, the reinforcement parts made from fiber composite are inserted. Fresh standard concrete is filled into the casing up to the height of the first section of the vertical building part. Then the second section of the vertical building part is produced by fresh light-weight concrete being filled into the upper section of the casing.

The reinforcement rods in the upper section may already be inserted prior to the cast-in-place concrete being filled into the lower section and connected to the reinforcement of the lower section. Alternatively, the reinforcement rods may also be impressed into the still fresh cast-in-place concrete after the concrete has been filled into the lower casing section and compacted. The insertion of the fresh cast-in-place light-weight concrete may be delayed until the cast-in-place concrete in the lower casing section has set. If the surface has been properly treated the light-weight concrete can also be installed in completely cured cast-in-place concrete.

A horizontal building part, e.g., a ceiling, shall also be understood within the scope of the present invention as an offset abutting the vertical building part, thus e.g., a support. This way, e.g., a support can be prepared up to just below a ceiling located thereabove. The casing for the ceiling may abut the casing still left at the support and prepared from cast-in-place concrete such that a minor clearing remains above the support inside its casing and is also filled with cast-in-place concrete of the ceiling and thus forms an offset section.

BRIEF DESCRIPTION OF THE DRAWINGS

Additional features, advantages, and characteristics of the present invention are explained in the following based on the figures and based on exemplary embodiments. Shown here are.

DETAILED DESCRIPTION OF THE PREFERRED EMBODIMENTS

Figure 1:
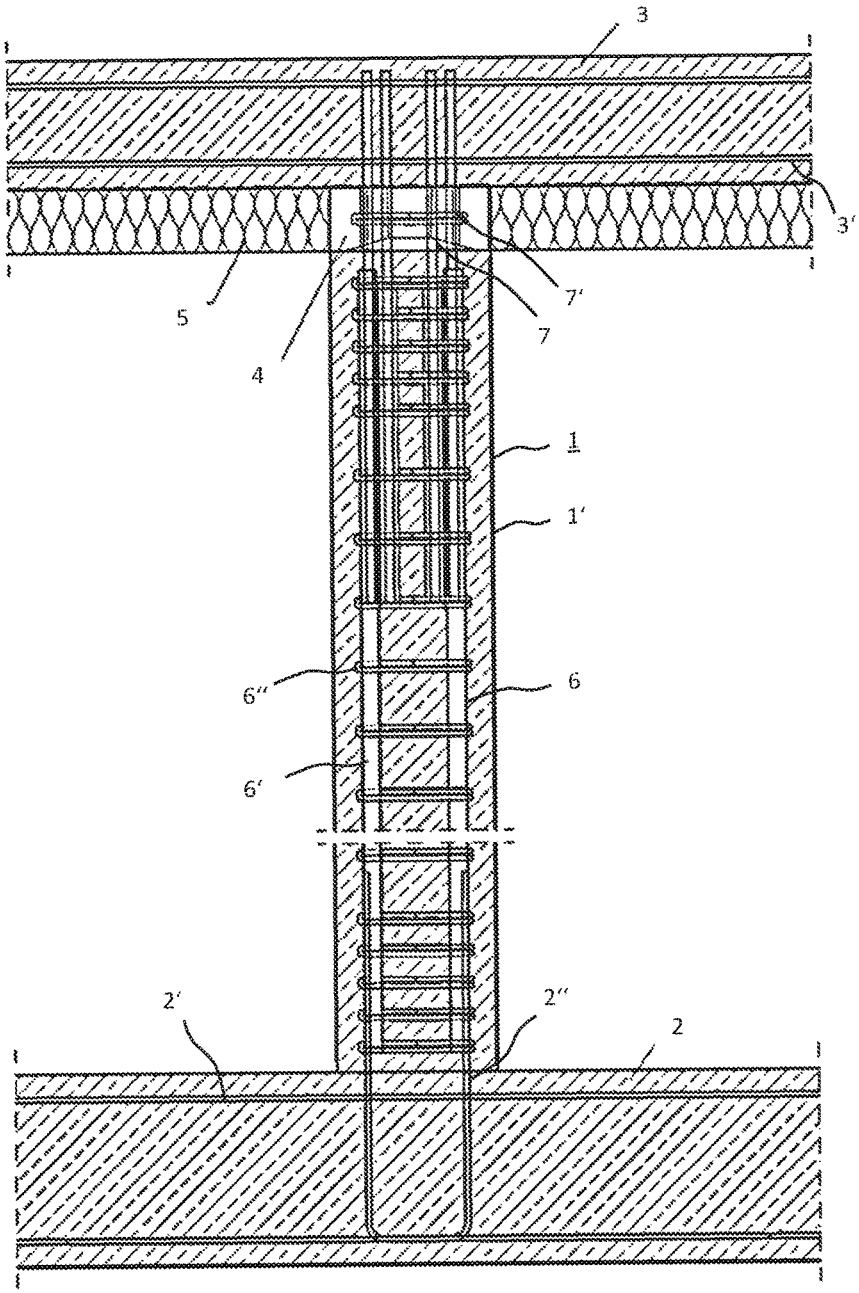
FIG. 1 a section through a support made from concrete and building parts located above and below thereof, FIG. 2 an isometric view of a thermal insulation element according to the invention made from a compressive load-transferring material, particularly light-weight concrete, FIG. 3 a top view of the thermal insulation element of FIG. 2, FIG. 4 a vertical cross-section through the thermal insulation element along the sectional line C-C of FIG. 3, FIG. 5 a further development of the thermal insulation element of FIG. 2 in a side view, FIG. 6 a cross-section through the support of FIG. 1, FIG. 7 the reinforcement of the support of FIG. 1 with the thermal insulation element prior to the casing of the support being filled with cast-in-place concrete, FIG. 8 the support provided with a casing after being filled with concrete, FIG. 9 an enlarged section of FIG. 8, and FIG. 10 an alternative exemplary embodiment with a thermal insulation element arranged in the base section of a support.

In a first exemplary embodiment shown in FIG. 1 a support 1 is provided, monolithically connected to a base plate 2 and a ceiling 3. The upper section 4 of the support is made from light-weight concrete, while the lower section 1' is made from standard cast-in-place concrete (standard concrete). The support 1 may for example have a clear height of 220 cm. The upper section thereof amounts to 10 cm. A thermal insulation layer 5 made from a highly insulating material is applied below the ceiling, with its thickness essentially being equivalent to at least the height of the upper section 4 of the support 1. For example, mineral insulation plates or excelsior multilayer boards may be installed as the thermal insulation layer 6.

In order to prepare the building parts shown in FIG. 1, firstly the base plate 2 with the reinforcement 2' is cast in concrete in a conventional fashion. In order to connect the support 1 to the base plate, here reinforcement rods 2" project vertically upwards from the horizontal reinforcement 2' of the base plate 2. They are then connected to the reinforcement 6 made from construction steel and arranged inside the support 1. The reinforcement 6 comprises four vertical reinforcement rods 6' and a plurality of reinforcement bars 6" arranged distanced in the vertical direction and showing an approximately square layout. In the upper section 4, instead of reinforcement rods 6' made from construction steel, here four reinforcement rods 7 made from fiber composite are inserted, for example the fiber composite material distributed by the applicant under the tradename ComBAR®. In the upper section 4 reinforcements surround the reinforcement rods 7, arranged perpendicular in reference thereto, for example a reinforcement bar 7' made from stainless steel. The reinforcement rods 7 project beyond the upper section 4 of the support in order to allow a monolithic connection to the ceiling 3 to be produced above thereof at a later time. Additionally, the reinforcement rods 7 also project from the upper section of the support, serving as the thermal insulation element, into the lower section 1' made from standard concrete.

Then a casing (cf. FIG. 8) is erected around the reinforcement 6 and closed at all sides for the support 1. Subsequently cast-in-place concrete is inserted, namely up to the height of the lower section 1', thus in the exemplary embodiment to a height of approximately 210 cm. The cast-in-place concrete, here typical ready-to-use standard concrete provided on construction sites, is then compacted with an internal vibrator. When the cast-in-place concrete has set fresh light-weight concrete is filled into the casing provided in the upper section 4 located thereabove and also compacted. As soon as it has set, in a manner also known per se the production of the ceiling 3 can continue, with its reinforcement 3' being cast in cast-in-place concrete together with the reinforcement rods 7 projecting beyond the upper contact area of the support 1 and made from fiber composite material.

Alternatively to producing the upper section 4 of the support 1, serving as the thermal insulation element, from a special light-weight cast-in-place concrete, here a prefabricated form part may also be installed as the thermal insulation element in the casing of the support. In this case the casing of the support is either filled through an opening in the form part with cast-in-place concrete or the casing is initially filled with cast-in-place concrete up to the elevation of the lower section 1' and the form part is then inserted from the top into the casing and impressed into the still fresh cast-in-place concrete of the support 1. Here it is beneficial to insert an internal vibrator through a central opening into the form part in order to subsequently compact the cast-in-place concrete in the connection area.

Figure 2:
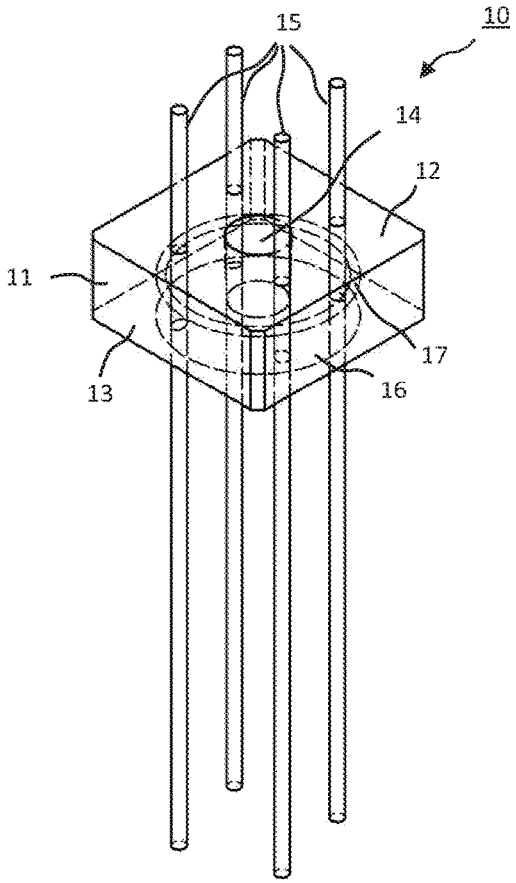
Figure 4:
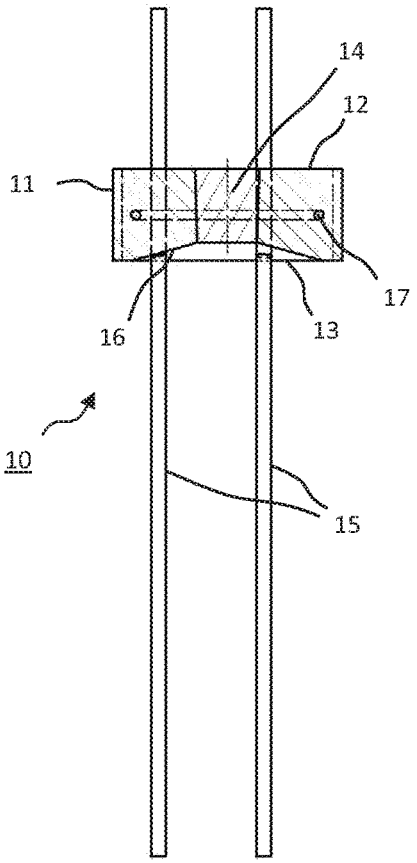
Figure 3:
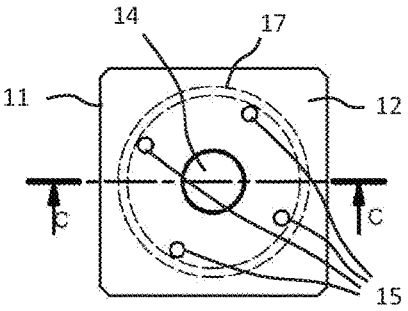

FIGS. 2 to 4 show a thermal insulation element 10 comprising such a form part. It serves for the monolithic connection and for the load-transferring connection of a support 1 made from concrete, for example in the lower level of a building, to the basement ceiling 3 located thereabove. The thermal insulation element 10 has a cuboid base element 11 with a top 12 and a bottom 13, each serving as support areas for the basement ceiling and/or the end of the support 1 carrying it. A central penetrating opening 14 is located in the middle of the cuboid thermal insulation element 10, which extends from the top 12 to the bottom 13 of the thermal insulation element 11. Four reinforcement rods 15 made from fiber composite project through the basic body 11. The bottom 13 of the basic body has a three-dimensional profiling in the form of a recess 16 extending like a funnel in the direction of the penetrating opening 14. Inside the basic body 11, additionally a reinforcement rod 17 is embedded, which is arranged around the reinforcement rods 15 and provides additional stability for the thermal insulation element 10.

The basic body 11 of the thermal insulation element 10 is made from light-weight concrete, which on the one hand has high compressive load stability and on the other hand has good thermal insulating features. Compared to concrete with a thermal conductivity of approx. 1.6 W/(m·K), when using suitable light-weight concrete the thermal conductivity amounts to approx. 0.5 W/(m·K), which is equivalent to an improvement by approx. 70%. The light-weight concrete used essentially comprises expanded clay, fine sand, preferably light-weight sand, flux agents, as well as stabilizers, preventing any separating or floating of the grain and improving the processing features.

The compressive strength of the thermal insulation element is here sufficiently high to allow the statically planned utilization of the underlying support made from cast-in-place concrete, for example according to the compressive strength classification C25/30. Preferably the compressive strength of the thermal insulation element is at least equivalent to 1.5 times the value required by static loads. This achieves that even in case of potential faulty sections at the connection area of the thermal insulation element to the support, here safety reserves are given so that the thermal insulation element remains statically stable even in case of punctually higher stress.

The reinforcement rods 15 crossing the basic body 11 of the thermal insulation element 10 in the vertical direction serve primarily as tensile rods for transferring potentially arising tensile forces. The reinforcing rods 15 may be encased in concrete during the production of the thermal insulation element 10 in the light-weight concrete of the cuboid basic body 11. Alternatively, it is possible for an easier production of the thermal insulation element to install sheaths during the production as a type of dead casing, through which the reinforcement rods 15 are inserted after the curing of the light-weight concrete element 11.

In the exemplary embodiment, the reinforcement rods 15 themselves are made from a fibrous composite, which comprises fiberglass aligned in the direction of force or a synthetic resin matrix. Such a fiberglass reinforcement rod have an extremely low thermal conductivity, which is up to 100 times lower than the one of concrete steel, and thus it is ideally suitable for the application in the thermal insulation element. Alternatively, reinforcement rods comprising stainless steel may be used as well within the scope of the present invention, particularly when using the above-mentioned sheaths as dead casings.

Without limiting the invention thereto, the dimensions of the reinforcement rods 15 amount in the exemplary embodiment to a diameter of 16 mm with a length of 930 mm. The arrangement of the reinforcement rods 15 in reference to the base area of the basic body 11 is selected slightly outside the primary diagonal. The reason for this is given here in that in a support 1, in which the reinforcement rods 15 of the thermal insulation element 10 are installed, the reinforcement rods 6' of the support 1 are already located in the corners.

The reinforcement rod 17 comprises a stainless steel bent to form a ring which is welded to the connection site. The reinforcement rod 17 shows a diameter of approx. 200 mm with a material thickness of 8 mm to 10 mm.

In the exemplary embodiment the basic body 11 of the thermal insulation element 10 has a length of 250×250 mm at the edges. The height amounts to 100 mm and thus it is equivalent to the common thickness of a subsequently applied thermal insulation layer. As discernible primarily in FIG. 4, the penetrating opening extends in a slightly conical fashion, with here the penetrating opening 14 tapering from an upper dimension of 70 mm to a lower dimension of 65 mm. The penetrating opening can also be easily closed via an appropriate, also slightly conical plug (not shown).

Figure 5:
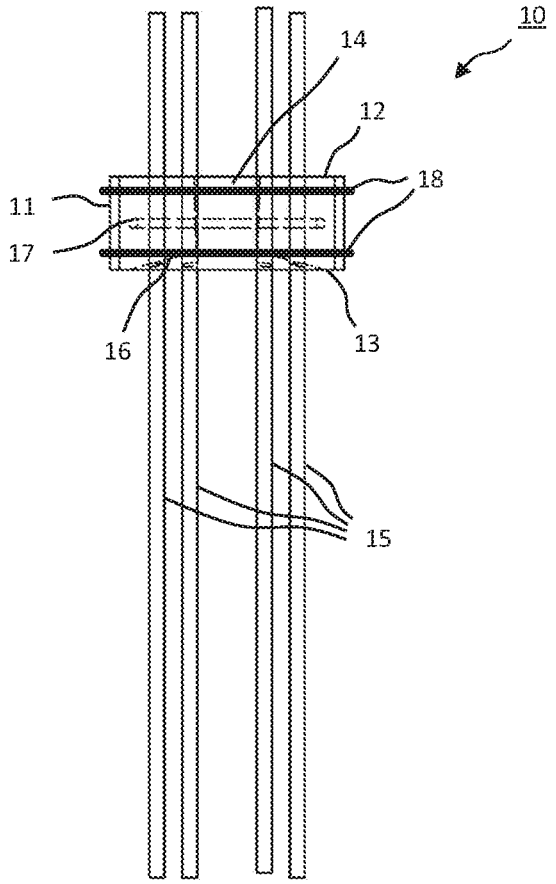

FIG. 5 shows the thermal insulation element in a side view, with additional circumferential seals 18 being applied at the basic body 11. The seals 18 may be embodied as rubber lips or conventional sealing tape, for example. They serve to seal the basic body 11 of the thermal insulation element 10 tightly at the edges towards a casing for the support to be constructed underneath thereof, in order to prevent any rising of concrete or the penetration of air.

Figure 6:
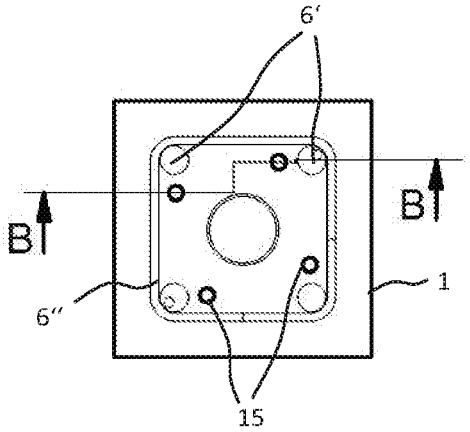

FIG. 6 shows an installation situation of the thermal insulation element in reference to a support 1. The cross-section shown here extends underneath the basic body 11 of the thermal insulation element 10. The support 1 made from cast-in-place concrete shows reinforcements with four vertical reinforcing rods 6' arranged in the corners of the support 1 and a plurality of reinforcement bars 6" extending horizontally about the reinforcement rods 6' and embodied in an approximately square fashion. The reinforcing rods 15 of the thermal insulation element 10 are each located slightly offset next to the reinforcing rods 6' of the support 1. The sectional line B-B indicated in FIG. 6 is equivalent to the progression of the line of the longitudinal cross-section through the support reinforcement shown in FIG. 7.

Figure 7:
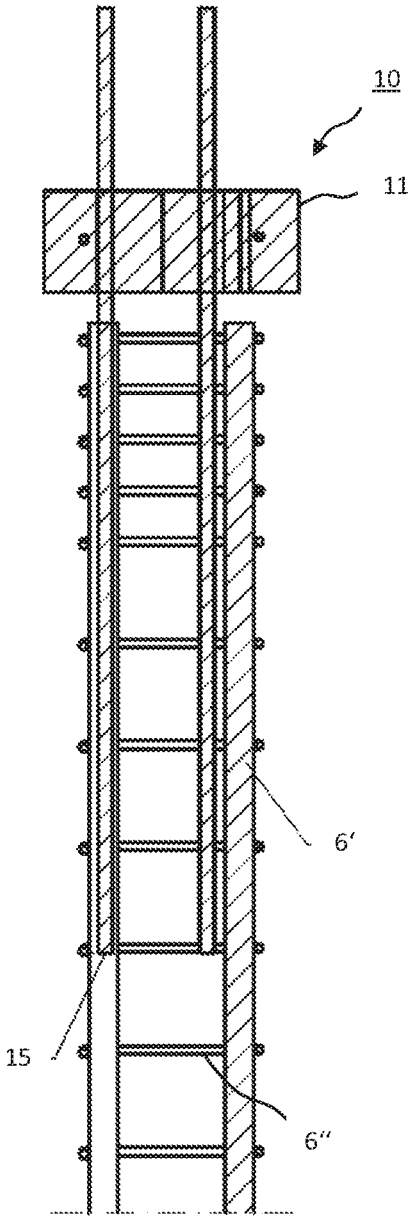

FIG. 7 shows the reinforcement of the support 1 together with the thermal insulation element 10 in a longitudinal cross-section. The progression of the section is here equivalent to the sectional line B-B of FIG. 6. The reinforcement of the support 1 comprises four vertical reinforcement rods 6' arranged in the corners of the support, which for example may be embodied from construction steel with the rods showing a diameter of 28 mm at a length of 2000 mm, as well as a plurality of reinforcement bars 6" arranged circumferential about the reinforcement rods 6' showing an approximately square layout. The thermal insulation element 10 is located above the reinforcement of the support, with its reinforcement rods 15 projecting downwards into the support reinforcement.

The reinforcement content of the support 1 amounts to approximately 3-4%. At a typical thermal conductivity value of construction steel of approx. 50 W/(m·K) in reference to concrete with 1.6 W/(m·K) it contributes approximately to half the total thermal conductivity of the support. By the use of the combination of light-weight concrete and fiberglass reinforcement in the area of the thermal insulation element 10 the thermal conductivity between the support 1 and the ceiling 3 can therefore be reduced by approx. 90% in reference to a direct monolithic connection.

Figure 8:
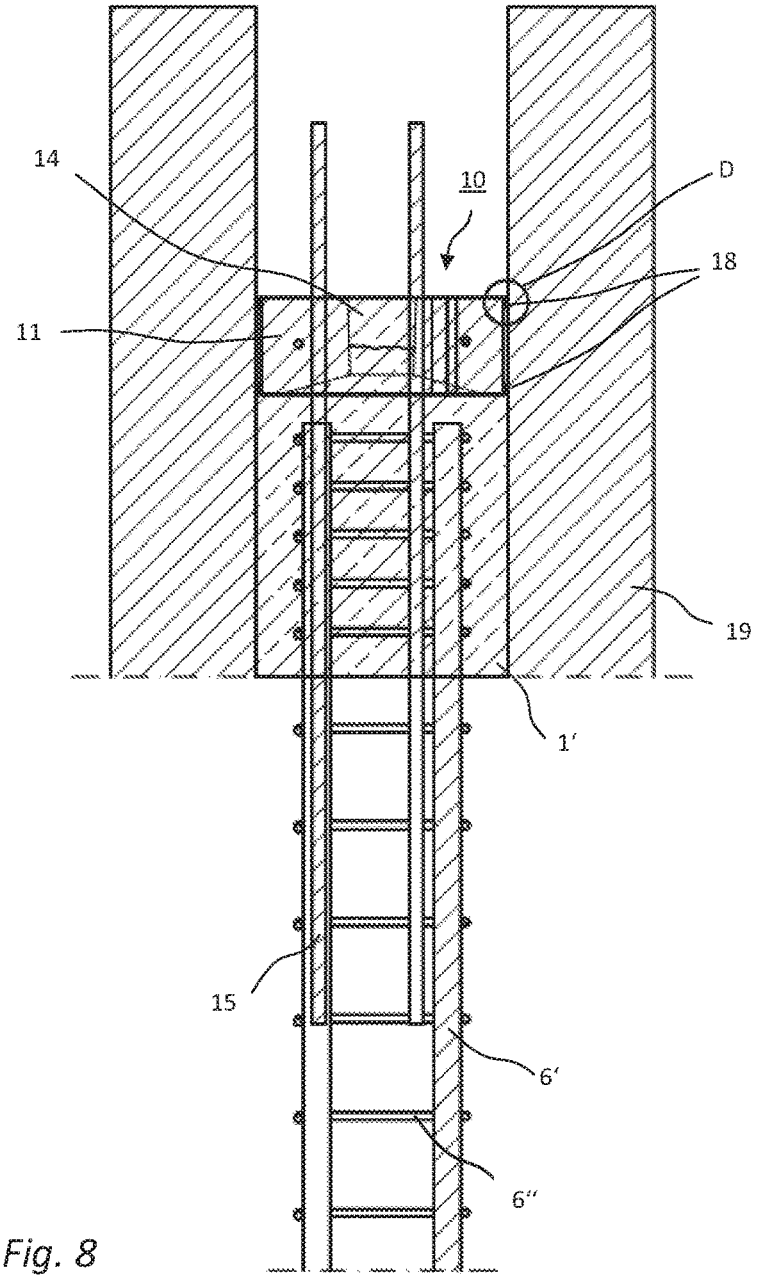
Figure 9:
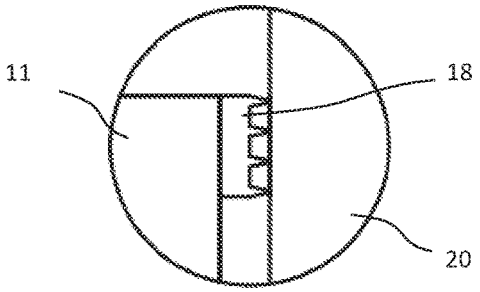

In order to prepare the support 1, as shown in FIG. 8 in the upper half, a casing 19 is installed about the support reinforcement 6', 6" and the lower section 1' is filled with cast-in-place concrete. It is compacted in a conventional fashion with an internal vibrator. Subsequently the thermal insulation element 10 is inserted into the casing 19 from above and its reinforcement rods 15 are pressed into the still liquid cast-in-place concrete. The basic body 11 is compressed to the fresh cast-in-place concrete until the liquid concrete slightly rises upwards in the penetrating opening 14 such that it is ensured that no more air gap is given between the concrete of the support 1 and the basic body 11 of the thermal insulation element 10. Subsequently the vibration head of a concrete vibrator is inserted through the penetrating opening 14 into the fresh cast-in-place concrete located underneath in order to compact it once more. When inserting the vibration head the thermal insulation element 10 can be slightly raised by the volume of the concrete displaced by the vibration head. When pulling out the vibration head it must therefore be ensured that the thermal insulation element 10 lowers again by said volume in that the thermal insulation element 10 is pushed downwards accordingly when the vibrator is pulled out. Here, the circumferential seal 18 prevents air from penetrating between the casing and the thermal insulation element or the thermal insulation element 10 can tilt inside the casing. FIG. 9 displays the section marked detail D around one of the seals 18 once more in an enlarged fashion.

The subsequent compacting of the still liquid fresh concrete via the penetrating opening 14 of the thermal insulation element 10 leads to a close connection of the thermal insulation element 10 with the cast-in-place concrete located underneath. In particular, elevations due to the formation of bubbles or sedimentation in the fresh concrete are prevented between the thermal insulation element 10 and the support 1. This is promoted primarily also by the conically extending profiling at the bottom of the basic body 11, based on which the rising air bubbles and/or the surface of the separated cement water can collect primarily in the central area of the penetrating opening 14.

After the support was formed from concrete and the subsequent compacting via the penetrating opening 14 any remnants of concrete remaining in the penetrating opening 14 are removed. Subsequently the penetrating opening 14 is closed via a conical plug (not shown). The closing plug may comprise an insulating material, such as polystyrene or the like, and serves to prevent the penetration of cast-in-place concrete into the penetration opening 14 when subsequently the ceiling 3 is produced. This way potential heat bridges are avoided due to a concrete filling in the penetrating opening 14. Subsequently, above the thermal insulation element 10 the ceiling 3 located thereabove is produced in a common fashion.

Except for the purpose of compacting and/or subsequent compacting the penetrating opening 14 can also be used as an inlet for filling the casing for the support 1 with cast-in-place concrete. In this case, the thermal insulation element is inserted into the still empty casing of the support 1 and perhaps the reinforcement rods 15 are connected to the support reinforcement. Subsequently fresh concrete is filled via the penetrating opening 14 of the thermal insulation element into the casing and then compacted by a vibration head of an internal vibrator being inserted through the penetrating opening 14. Here, too the compacting of fresh concrete against the bottom of the thermal insulation element occurs from the top through the penetrating opening 14. Alternatively the support 1 can also be prepared from self-compacting concrete or the compacting of the support can occur by an external vibrator, of course. Therefore in the latter two cases the penetrating opening 14 serves only as an inlet opening.

Figure 10:
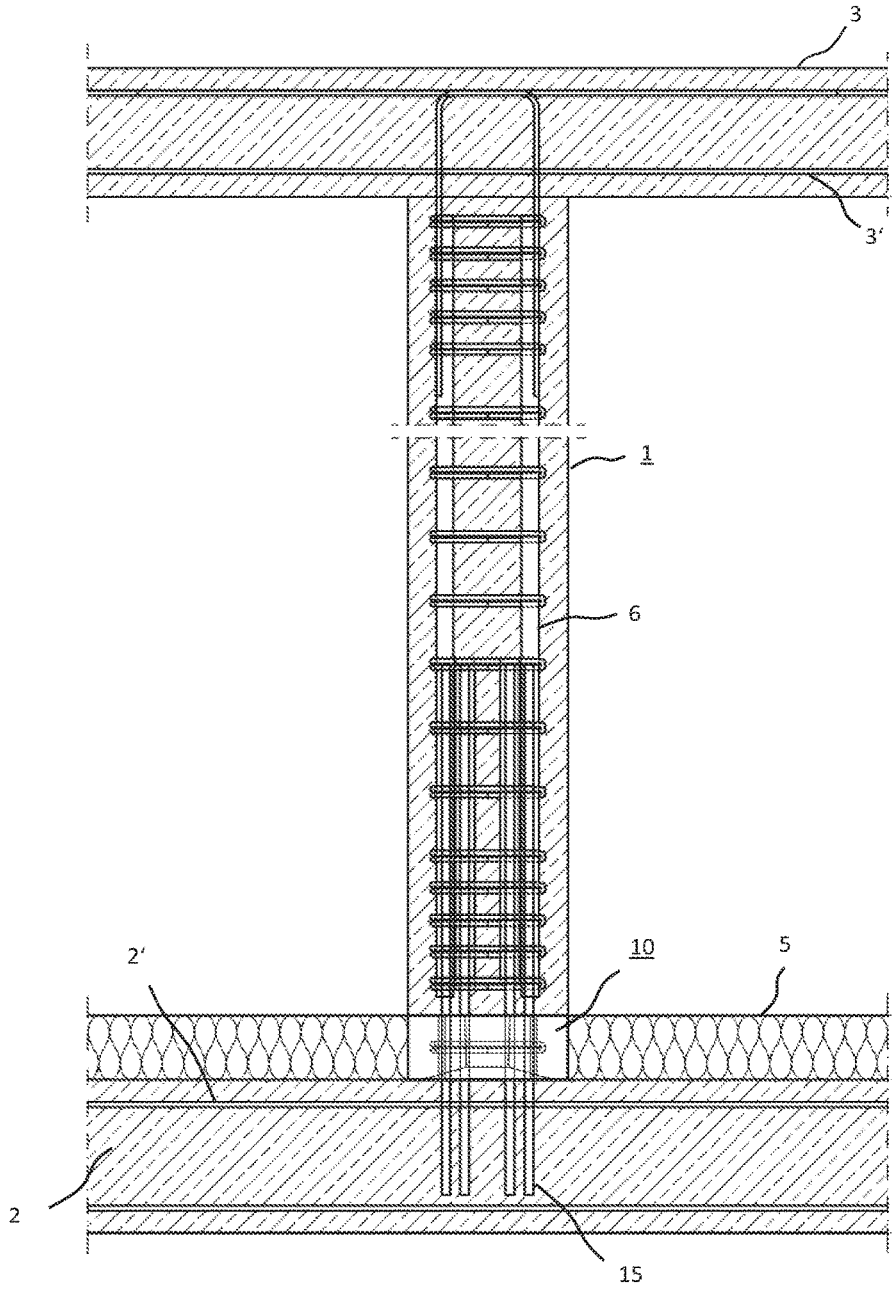

In addition to the installation in the upper area of a support, an installation in the base of a support is possible as well. Such an arrangement is shown in FIG. 10 in an alternative exemplary embodiment. The support 1 is here arranged between the bottom plate 2 and the upper ceiling 3. In the base area of the support 1 a thermal insulation element 10 according to the invention is installed, with its reinforcement rods 15 projecting from the base plate 2 to the upper area of the support 1, and here being connected to the reinforcement 6 of the support 1. A thermal insulation layer 5 made from insulation plates of prior art is applied in this case on the top of the bottom plate 2.

The production can occur such that the thermal insulation element 10 is connected to its reinforcement 2' before the base plate 2 is cast from concrete. The base plate 2 is then cast from cast-in-place concrete such that the concrete rises from the bottom towards the thermal insulation element 10. In order to yield a good connection free from clear space the cast-in-place concrete can in turn be compacted with a vibration tool passed through the central penetrating opening. After curing the reinforcement 6 of the support is produced and connected to the reinforcement rods 15 of the thermal insulation element. Subsequently the casing for the support 1 is constructed around the thermal insulation element 10 and then the support 1 is cast and compacted from cast-in-place concrete in a conventional fashion.

The thermal insulation element according to the invention itself may be adjusted in its dimensions to the construction part located underneath and/or above. In particular, thermal insulation elements may be adjusted to the typical cross-sections of supports with round, square, or rectangular cross-sections. Typical dimensions of round supports are diameters of 24 and 30 cm, and/or supports with rectangular cross-sections of 25×25 cm and 30×30 cm. Thermal insulation elements with such a geometry may also be combined arbitrarily to form greater supports or load bearing walls The thermal insulation elements described here are particularly suited for the use in connecting links, such as wall supports with low fixing moments. Additionally, the use of load bearing exterior walls is also possible by installing thermal insulation elements at a suitable distance from each other and any perhaps remaining gaps between the individual thermal insulation elements can be filled with insulation material that is not load bearing.

The geometric design of the profiled bottom of the thermal insulation element may also be realized in many other ways, in addition to the conical shape shown here, for example a stepped form, a radial gearing, an annular bead, and so forth.

In addition to optimizing the geometry of the bottom of the thermal insulation element more and/or alternatively smaller openings may be provided for subsequently casting potentially remaining cavities between the thermal insulation element and the concrete area located underneath. Such openings may be closed with plugs and opened when needed in order to subsequently fill any potentially remaining cavities via a casting mass, such as casting mortar or a synthetic resin, and thus to generate a secure static connection, although in the individual case a faulty embodiment during the preparation of the support and/or the installation of the thermal insulation element had resulted in a flawed connection. Additionally, indicators may be provided at the thermal insulation element which can be pressed upwards like a float and here indicate that the thermal insulation element with its bottom is in contact with the cast-in-place concrete located underneath thereof.

During the installation of the thermal insulation element into already compacted, fresh concrete of the support located underneath, during the subsequent re-compacting, and when the compacting tool being pulled out of the penetrating opening of the thermal insulation element it may be advantageous if a defined compression is applied upon the thermal insulation element.

In addition to the reinforcement rods, within the scope of the present invention other rod-shaped reinforcing elements may be used for connecting the thermal insulation elements to the building parts located above and below, for example threaded rods, dowels, and the like, because as explained above the connection between a support and a ceiling located thereabove can be considered a link with regards to statics and the reinforcement at this point must therefore fulfill a constructive function.

The invention claimed is:

1. A load-bearing vertical building part (1), made from concrete, comprising a first section with a first support area (12, 13) for a load-transferring connection to a horizontal building part (2, 3) to be made from concrete located thereabove or therebelow, reinforcements (6, 7) with one or more rod-shaped reinforcement elements projecting essentially vertically beyond the first support area (12, 13), the first section (4) of the vertical building part comprises a thermal insulation element (10) for thermal decoupling of the vertical building part from the horizontal building part to be produced thereabove or therebelow, the first section (4) is formed of a light-weight concrete having a dry density of below 2000 kg/m3 and a thermal conductivity of between 0.2 and 1.6 W/(m·K), and the rod-shaped reinforcement elements (7', 15) projecting beyond the first support area (12, 13) are made from a fiber composite material and essentially extend vertically through the first section (4) of the vertical building part, forming the thermal insulation element (10), to a second section (1') abutting thereat, in which the vertical building part is produced from reinforced concrete having a dry density of above 2000 kg/m$^3$, and wherein a compressive load of the building parts above the first support area (12) is carried by the first section (4) without any integrated compression elements of higher compressive strength.

2. A thermal insulation element for the thermal decoupling of load bearing building parts to be created from concrete, the thermal insulation element (10) comprising a basic body (11) with an upper support area and a lower support area (12, 13) for vertical connection to building parts (1, 2, 3), the basic body (11) being made from a light-weight concrete having a dry density of below 2000 kg/m3 and a thermal conductivity of between 0.2 and 1.6 W/(m·K) and being dimensioned such that when integrated into a building, the basic body (11) is adapted to carry a compressive load of the building parts above said upper support area (12) without any integrated compression elements of higher compressive strength in the basic body, and one or more rod-shaped reinforcement elements (15) penetrating the basic body (11) and extending essentially vertically beyond the upper and the lower support areas (12, 13).

3. The thermal insulation element according to claim 2, wherein the rod-shaped reinforcement elements comprise reinforcement rods (15) that are inserted in sheaths, which are embedded in the compressive force-transferring material.

4. The thermal insulation element according to claim 2, further comprising at least one penetrating opening (14) extending from the upper support area to the lower support area (12, 13), which is embodied for introducing a compacting device for fresh concrete.

5. The thermal insulation element according to claim 4, wherein the lower support area (13) has a three-dimensional profiled surface.

6. The thermal insulation element according to claim 5, wherein the lower support area has a surface declined or arched like a funnel in a direction of the penetrating opening (14).

7. The thermal insulation element according to claim 4, further comprising a plug for subsequent closing of the penetrating opening (14), with the plug being made from a thermally insulating material.

8. The thermal insulation element according to claim 2, further comprising a reinforcement bar (17) arranged inside of the compressive force-transferring material.

9. The thermal insulation element according to claim 2, wherein the basic body has a coefficient of elasticity which is lower than an elasticity module of standard concrete.

10. A thermal insulation element for the thermal decoupling of load-bearing building parts to be made from concrete, the thermal insulation element (10) comprising a basic body (11) with an upper support area and a lower support area (12, 13) for vertical connection to building parts (1, 2, 3), the basic body (11) being made from a light-weight concrete having a dry density of below 2000 kg/m3 and a thermal conductivity of between 0.2 and 1.6 W/(m·K) and being dimensioned such that when integrated into a building, the basic body (11) is adapted to carry a compressive load of the building parts above said upper support area (12) without any integrated compression elements of higher compressive strength in the basic body, and one or more sheaths penetrating the basic body (11) vertically from the upper support area to the lower support area (12, 13), adapted for inserting rod-shaped reinforcement elements that extend essentially vertically beyond the upper and the lower support areas (12, 13).

* * * * *